United States Patent [19]

McLarty

[11] Patent Number: 4,463,569

[45] Date of Patent: Aug. 7, 1984

[54] SOLID-STATE HEATING AND COOLING APPARATUS

[76] Inventor: Gerald E. McLarty, 3010 E. Desert Cove, Phoenix, Ariz. 85028

[21] Appl. No.: 423,865

[22] Filed: Sep. 27, 1982

[51] Int. Cl.[3] ..... F25B 21/02

[52] U.S. Cl. ..... 62/3

[58] Field of Search ..... 62/3

[56] References Cited

U.S. PATENT DOCUMENTS

| | | | |
|---|---|---|---|
| 2,949,014 | 8/1960 | Belton, Jr. et al. | 62/3 |
| 3,330,970 | 7/1967 | Wennerberg et al. | 62/3 X |
| 3,552,133 | 1/1971 | Lukomsky | 62/3 |
| 3,557,565 | 1/1971 | Kissel | 62/3 |

*Primary Examiner*—Lloyd L. King

*Attorney, Agent, or Firm*—Harry M. Weiss

[57] ABSTRACT

A solid state heating and cooling apparatus for controlling the temperature of a room includes a plurality of series-coupled thermoelectric modules having first and second sides which become hot and cold, respectively, when current passes through said modules in a first direction and which become cold and hot, respectively, when current passes through in a second opposite direction. First and second heat sinks are placed proximate to the first and second sides to be either heated or cooled thereby. A first inlet duct having a fan therein cooperates with a first outlet duct so as to cause air to flow from the room whose temperature is to be controlled past the first heat sink and back into the room. A second inlet duct has a fan positioned therein so as to cause waste air to flow past the second heat sink and through a second outlet duct to an area apart from the room whose temperature is to be controlled. A polarity reversal circuit is provided for changing the direction of the current flowing through the thermoelectric modules to switch from a heating mode to a cooling mode or from a cooling mode to a heating mode and the polarity reversal circuit may be either manual or automatic.

11 Claims, 3 Drawing Figures

SOLID-STATE HEATING AND COOLING APPARATUS

BACKGROUND OF THE INVENTION

1. Field of the Invention

This invention relates generally to heating and air conditioning systems and, more particularly, to a solid state heating and air conditioning system employing thermoelectric modules.

2. Description of the Prior Art

As is well-known, the costs associated with heating and cooling the interior of a structure such as a residence, office, etc. are increasing dramatically due to the current energy shortages. The conventional freon-pumped systems suffer from several disadvantages. First, both the initial costs of manufacture and installation are high. Second, such systems are expensive to operate and maintain. Third, the conventional systems are complex and require many moving parts. As a result, maintenance is often a problem. Another disadvantage resides in the fact that standard central heating/air conditioning systems generally operate off a single thermostat and therefore cannot maintain individual room temperatures. Finally, it is well-known that freon is detrimental to the Earth's ozone layer.

In a thermoelectric cooling system, a cold junction is produced where heat is absorbed by electrons while moving from a lower energy state to a higher energy state. A power supply provides the energy required to move the electrons through the energy state system. A heat exchanger is attached to a hot junction to expel excess heat.

Thermoelectric cooling "couples" are made from two elements of semiconductor material, primarily Bismuth Telluride, heavily doped to create an excess (N-type) or a deficiency (P-type) of electrons. Heat absorbed at a cold junction is pumped to a hot junction at a rate proportional to the current passing through the "couple". In practical applications, a plurality of couples are combined in a module where they are connected in series electrically and in parallel thermally. Such modules are commercially available from Material Electronic Products Corporation, Trenton, N.J.

The use of such thermoelectric heat pumps has thus far been limited to situations arising out of special considerations such as size, space, weight, environmental conditions, etc. For example, a typical unit measures one inch by one inch by 0.25 inches thick. Use may be found in military and aerospace applications, laboratory and scientific equipment, mobile refrigerators such as recreational vehicle refrigerators and mobile home refrigerators, portable picnic coolers, cream and butter dispensers, beverage coolers, etc.

SUMMARY OF THE INVENTION

It is an object of the present invention to provide an improved heating and air-conditioning system.

It is a further object of the present invention to provide an air conditioning and heating system which utilizes solid-state thermoelectric modules.

It is a still further object of the present invention to provide a freon-free air-conditioning/heating system.

Yet another object of the present invention is to provide an air-conditioning/heating system which utilizes a closed loop feedback system to maintain a desired temperature and is capable of maintaining individual room temperatures.

It is a still further object of the present invention to provide an air-conditioning/heating system which is smaller and less complex than conventional systems.

It is yet another object of the present invention to provide an air-conditioning and heating system that is less expensive to manufacture, install and operate than conventional systems.

A still further object of the present invention is to provide an improved solid-state air-conditioning/heating system which provides for continuous air circulation.

Another object of the present invention is to provide an improved air-conditioning/heating system which may be powered by batteries or solar cells.

According to a broad aspect of the invention there is provided a solid state heating and cooling apparatus for controlling the temperature of a room, comprising: at least one thermoelectric module having first and second sides, said first and second sides being hot and cold respectively when current passes through said module in a first direction and becoming cold and hot respectively when said current passes through said module in a second opposite direction; first means for supplying said current to said at least one thermoelectric module; a first inlet duct leading from said room to a first region proximate said first side; a first outlet duct leading from said first region to said room; a first fan for causing air to flow from said room to said first region via said first inlet duct and from said first region back to said room via said first outlet duct so as to cool said room when said first said is cold and to heat said room when said first side is hot; a second inlet duct leading from an area apart from said room to a second region proximate said second side; a second outlet duct leading from said second region to a region apart from said room; a second fan for causing waste air to flow into said second inlet duct, past said second region and out said second outlet duct; and second means for reversing the direction of current flowing through said at least one thermoelectric module.

The above and other objects, features and advantages of the present invention will be better understood from the following detailed description taken in conjunction with the accompanying drawings, in which:

DESCRIPTION OF THE PREFERRED EMBODIMENTS

Figure 1:
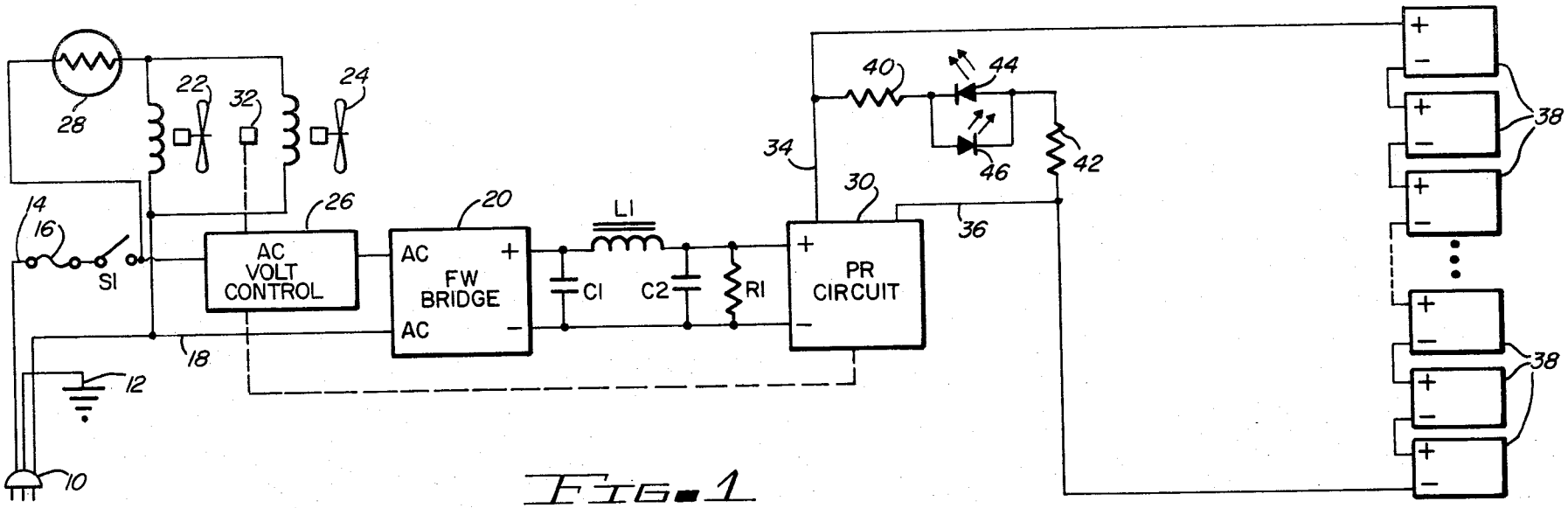
FIG. 1 is a schematic diagram of a first embodiment of the inventive solid state heating and cooling apparatus of the present invention.

Referring to FIG. 1, air-conditioning power is applied to the inventive solid state heating and cooling apparatus via a connector 10 having a ground conductor 12 coupled to ground, having a first conductor 14 coupled to a first terminal of a protective fuse 16, and a third conductor 18 coupled to a first terminal of a full wave bridge rectifier 20 and to first terminals of fans 22 and 24. The other side or second terminal of fuse 16 is coupled to a first terminal of a main on/off switch $S_1$, the output of which is coupled to an input of air-conditioning voltage control unit 26 and to a second terminal of fans 22 and 24 via varactor 28. The output of air-conditioning voltage control unit 26 is coupled to a second input of the full wave bridge rectifier 20.

The positive and negative output of full wave bridge rectifier 20 are coupled via a filter to the positive and negative input of a polarity reversal circuit 30. The filter comprises resistor R1, capacitors $C_1$ and $C_2$ and inductor $L_1$. A thermocouple-type pickup 32 is coupled to voltage control unit 26 and to polarity reversal circuit 30 for the control thereof.

First and second outputs 34 and 36 are coupled to first and second inputs of a plurality of series-coupled thermoelectric modules 38 of the type described hereinabove. Also coupled in series between outputs 34 and 36 of polarity reversal circuit 30 are resistors 40 and 42 and the parallel combination of oppositely poled diodes 44 and 46 for purposes to be described hereinbelow.

The circuit operates as follows:

Power is applied via connector 10, fuse 16 and main off/on switch $S_1$ to continuous running fans 22 and 24. Fan 22 is mounted on the room side of the unit, while fan 24 is mounted on the waste side of the unit. Thermocouple 32 measures the temperature of the incoming air, and controls voltage control unit 26 so as to control the amount of air-conditioning power which is applied to the full wave bridge rectifier circuit 20. As thermocouple 32 senses the need for heat, it directs polarity reversal circuit 30 to assume a state such that light-emitting diode (LED) 44 is forward biased and light emitting diode (LED) 46 is reverse biased. If light-emitting diode 44 is red and light-emitting diode 46 is green, then a red signal will indicate that the apparatus is operating in the heating mode with current flowing through the series coupled thermoelectric modules 38 in a direction to create a hot side adjacent fan 22. Thus, heat will be radiated in the room.

When thermocouple 32 senses the need of cooling, it causes polarity reversal circuit to reverse polarity causing current to flow through the thermoelectric modules 38 in a opposite direction creating a cold side adjacent fan 22 thus absorbing heat from the room. In this case, light-emitting diode 46 is forward biased. The light-emitting diodes not only indicate whether the apparatus is operating in a cooling or heating mode, but they also indicate by their intensity how hard the unit is heat pumping.

The filter formed by capacitors $C_1$ and $C_2$ and inductor $L_1$ is an active LC filter which reduces ripple to within 10 percent of the operating voltage. As will be apparent to one skilled in the art, the values of $C_1$, $C_2$ and $L_1$ will vary in accordance with the voltage and load.

As stated previously, the thermoelectric modules are arranged in series. This provides a higher voltage and less current whereas a parallel arrangement would provide higher current and a lower voltage. Thus, the series arrangement simplifies power supply requirements.

Figure 2:
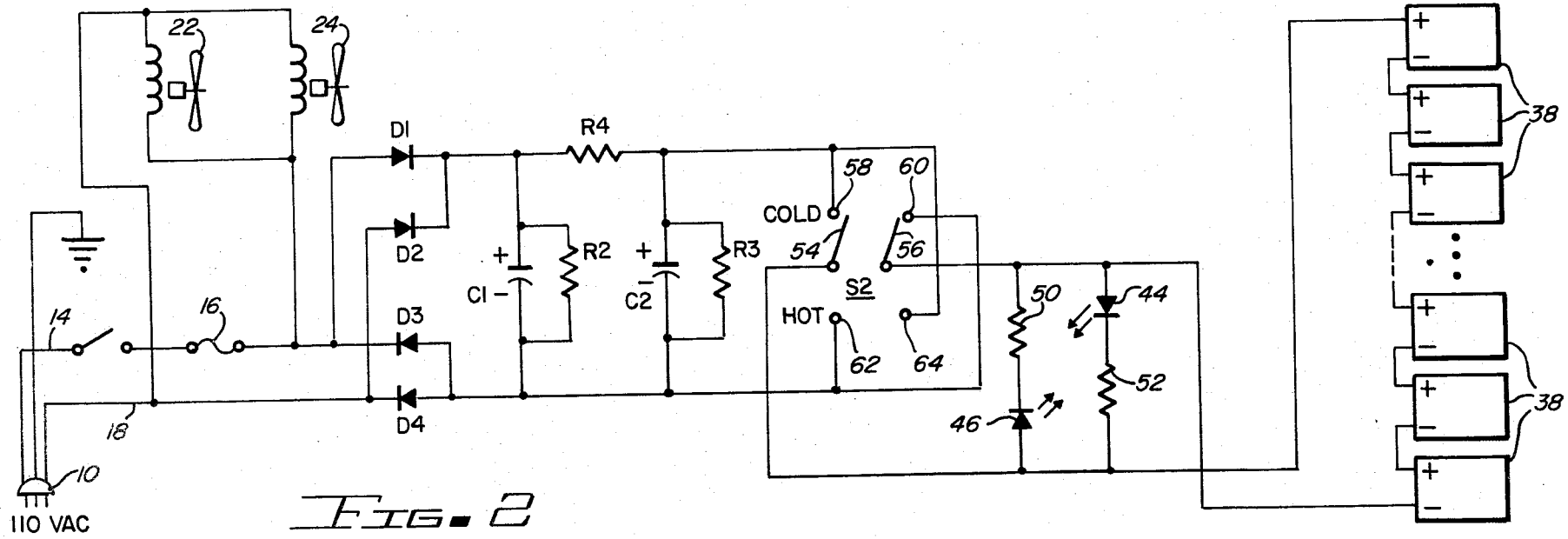
FIG. 2 is a schematic diagram of a second embodiment of the inventive solid state heating and cooling apparatus of the present invention.

FIG. 2 illustrates an alternate embodiment of the circuit shown in FIG. 1 with the greatest difference being that the circuit shown in FIG. 2 is not automatic but requires manual intervention to change the operating mode from heating to cooling and vice versa. Like elements have been denoted with like reference characters. It will be first noted that varactor 28 has been omitted from FIG. 2 and that the full wave bridge rectifier 20 in FIG. 1 is now shown as diodes D1, D2, D3 and D4 in FIG. 2. The LC filter shown in FIG. 1, has now been replaced with an alternate filter embodiment comprising capacitor $C_1$ and $C_2$ and resistors R2, R3 and R4.

The system is placed either in a heating or cooling mode by properly positioning arms 54 and 56 of switch S2 with respect to terminals 58, 60, 62 and 64. That is, with arms 54 contacting terminal 58 and arm 56 contacting terminal 60, then current flows such as to forward bias diode 56 and produce a cold side on thermoelectric modules 38 which is adjacent the exterior fan so as to absorb heat from the room and create a hot side adjacent fan 24 which is directed away from the room to be cooled. Similarly, when arm 54 and arm 56 are contacting terminals 62 and 64 respectively, current flows so as to forward bias diode 44 and create a hot side of thermoelectric modules 38 adjacent interior 22 so as to radiate heat into the room and a cold side adjacent waste fan 24.

Figure 3:
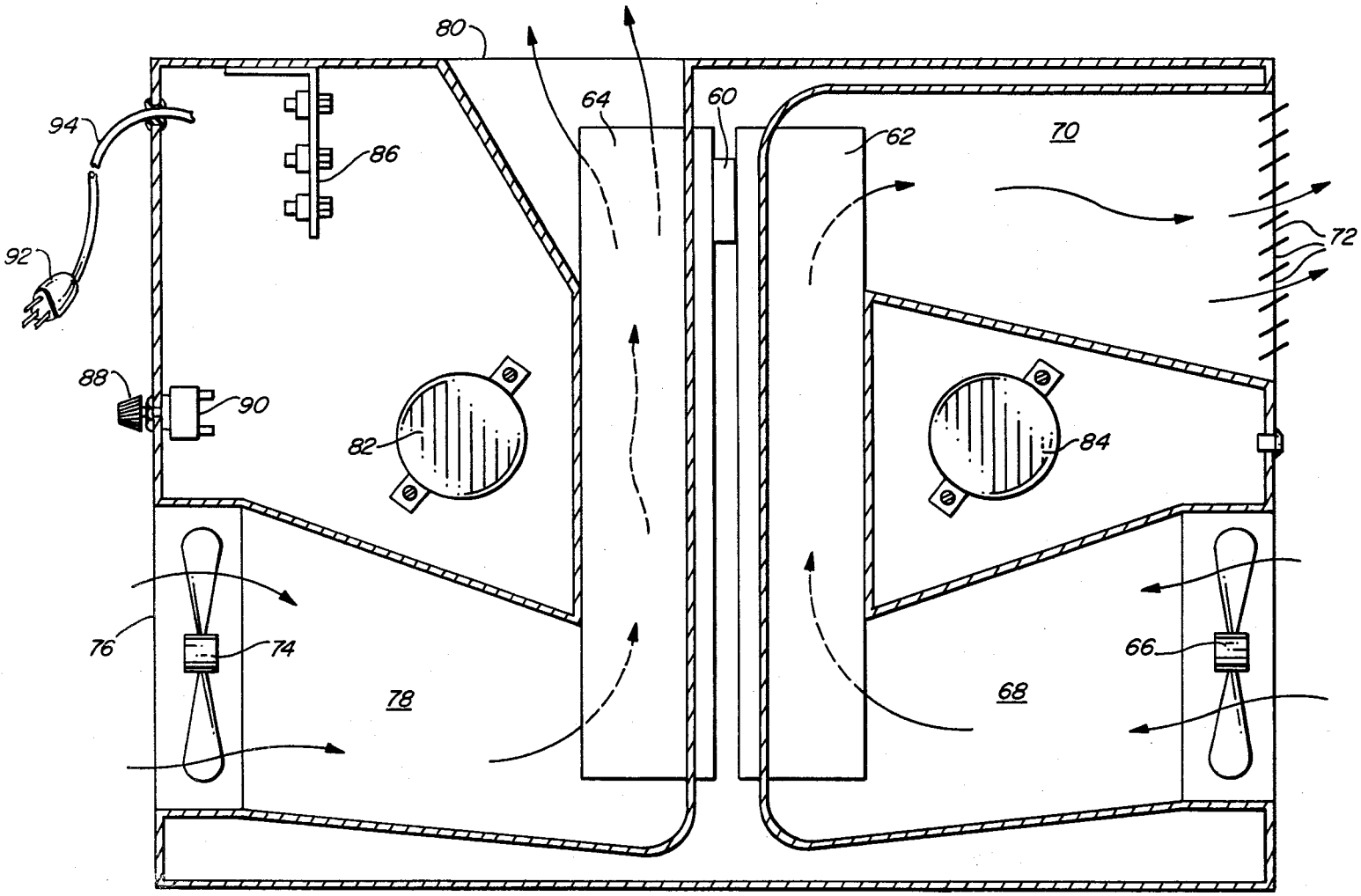
FIG. 3 is a plan view of the inventive solid state heating and cooling apparatus of the present invention.

FIG. 3 is a plan view of a solid state heating and cooling apparatus employing the circuitry of FIGS. 1 and 2 and which may be installed at ceiling level in a room to be controlled, or actually in the ceiling, or within existing ductwork. As can be seen, a plurality of series connected thermoelectric modules 60 is positioned with heat sinks 62 and 64 adjacent opposite sides thereof. Heat sinks 62 and 64 may, for example, be aluminum fin heat sinks. An inlet fan 66 is positioned adjacent a plurality of air inlet louvers and rotates so as to direct air from the room to be controlled through a duct 68 and past heat sink 62 to an outlet duct 70 and through a plurality of air outlet louvers 72 into the room to be controlled. If, for example, the system is operating in a heating mode, heat sink 62 will be adjacent to the hot side of thermoelectric modules 16 and heat sink 64 will be adjacent the cold side. Air from the room to be controlled will be pulled into duct 68 by fan 66 and past heat sink 62 where it will be heated and directed via duct 70 through louvers 72 and into the room to be heated. A waste air fan 74 is positioned adjacent a waste air inlet 76 for directing air through duct 78 and past heat sink 64. This air then exits by means of the waste air outlet 80. Heat from the waste air traveling through duct 78 will be absorbed by heat sink 64 and cooler air exiting outlet 80 will be directed to an area outside the room to be controlled. The filter capacitors 82 and 84, the full wave bridge rectifier 86, the on/off switch 88 and fuse 90 may be positioned as shown. The switch may also function as a heat/cool switch, and power is supplied to the circuit via connector 92 and cord 94.

If the system is operating in the cooling mode, the cold side of thermoelectric modules 60 will be adjacent sink 62 while its hot side will be adjacent to sink 64. In this case, air passing into duct 68 via fan 56 will pass by sink 62 and in doing so, heat will be absorbed into the sink causing cooler air to flow via duct 70 into the room via louver 72. The waste heat which is being collected in sink 64 is absorbed by cooler air passing into duct 60 by means of fan 74 and passing by sink 64 resulting in hotter air being exited at outlet 80.

Thus, there has been described an improved solid state heating and air-conditioning system which utilizes solid state thermoelectric modules. It is freon free and can be implemented to use a closed loop feedback system so as to maintain a desired temperature in an individual room. Furthermore, its implementation allows it to be smaller and less complex.

The above description is given by way of example only. Changes in form and detail may be made by one skilled in the art without departing from the scope of the invention as defined by the appended claims.

What is claimed is:

1. A solid state heating and cooling apparatus for controlling the temperature of a room, comprising:

at least one thermoelectric module having first and second sides, said first and second sides being hot and cold respectively when current passes through said module in a first direction and becoming cold and hot respectively when said current passes through said module in a second opposite direction, said thermoelectric module including a first air conduit region proximate said first side and a second air conduit region proximate said second side;

first means for supplying said current to said at least one thermoelectric module;

a first inlet duct leading from said room directly to one end of said first region proximate said first side;

a first outlet duct leading from the opposite end of said first region directly to said room;

a first fan means for causing air to flow from said room to said first region via said first inlet duct and from said first region back to said room via said first outlet duct so as to cool said room when said first side is cold and to heat said room when said first side is hot;

a second inlet duct leading directly from a remote area apart from said room to one end of said second region proximate said second side;

a second outlet duct leading directly from the opposite end of said second region to a area apart from said room;

a second fan means for causing waste air to flow into said second inlet duct, past said second region and out said second outlet duct; and second means for reversing the direction of current flowing through said at least one thermoelectric module for selectively heating and cooling said room for mainting a desired temperature therein.

2. The apparatus of claim 1 wherein said first means comprises:

a source of AC power; and means for converting said AC power to a source DC current.

3. The apparatus of claim 1 wherein said first means includes a battery.

4. The apparatus of claim 1 wherein said second means comprises manually-operable switch means electrically coupled to said means for converting said AC power to DC current for manually reversing the direction of said DC current so as to switch said apparatus from a cooling mode of operation to a heating mode of operation and vice versa.

5. The apparatus of claim 1 wherein said second means comprises:

temperature measuring means coupled proximate said first inlet duct for measuring the temperature of the air passing into said first inlet duct from said room; and a polarity reversal circuit coupled to said temperature measuring means to said at least one thermoelectric module and to said means for converting AC power to DC current for changing the direction of current flowing through said at least one thermoelectric module at a predetermined temperature.

6. The apparatus of claim 1 further including indicating means for visually indicating whether said apparatus is operating in a heating mode or a cooling mode.

7. The apparatus of claim 1 wherein said first fan means is operatively positioned within said first inlet duct and said second fan means is operatively positioned within said second inlet duct.

8. The apparatus of claim 1 further including an overhead duct system operatively disposed in an overhead portion of said room and wherein said apparatus includes a housing means for operatively containing said at least one thermoelectric module, said first inlet duct, said first outlet duct, said first fan means, said second inlet duct, said second outlet duct, said second fan means, said first means for supplying current, and said second means for reversing the direction of current, said housing means being operatively disposed substantially entirely within said overhead duct system.

9. A heating and cooling system for controlling the temperature of an individual room, comprising:

ducting means operatively disposed substantially entirely in the ceiling of an individual room whose temperature is to be independently controlled for forming an air conduit;

thermoelectric module means having first and second sides, said first and second sides being hot and cold, respectively, when current passes through said module in a first direction and becoming cold and hot, respectively, when said current passes through said module in a second opposite direction, said thermoelectric module means including a first air conducting region proximate said first side for radiant heat exchange therebetween and a second air conduit proximate said second side for radiant heat exchange therebetween;

means for supplying DC to said thermoelectric module means;

means upper housing said thermoelectric module means, said housing means operatively disposed within said ducting means proximate the center of the ceiling of the room whose temperature is to be controlled for establishing a first and second heat sink region proximate said first and second sides, respectively, each of said heat sink regions having an input and an output;

a first inlet duct means operatively coupled to said first heat sink region input of said housing means on said first side of said thermoelectric module means to said room whose temperature is to be controlled;

a first outlet duct means operatively coupling the first heat sink region output of said housing means on said first side of said thermoelectric module means to said room whose temperature is to be controlled for forming a closed loop system comprising the room whose temperature is to be controlled, said inlet duct means, said first heat sink region of said first side of said thermoelectric module means, said first inlet means and said first outlet means being operatively disposed within said housing means, in a side-by-side manner, for simultaneously opening onto said room;

a first fan means operatively disposed within said first inlet duct means of said housing means for drawing air from the room whose temperature is to be controlled and forcing said air through said first heat sink region for heat exchange purposes and from said first heat sink region output back into said room whose temperature is to be controlled for maintaining a continuous closed loop air flow therebetween;

a second inlet duct means operatively coupled to said second heat sink region input of said housing means on said second side of said thermoelectric module means to a remote external location;

a second outlet duct means operatively coupled to said second heat sink region output of said housing means on said second side of said thermoelectric module means to said remote said external location for forming a continuous air flow on the second side of said thermoelectric module means;

a second fan means operatively disposed within said second inlet duct means of said housing means for drawing air from the remote external location and forcing said air through said second heat sink region for heat exchange purposes and from said second heat sink region output back to said remote external location for maintaining a continuous flow therebetween;

means responsive to a predetermined difference between the temperature desired to be maintained within said room and the actual temperature of the air therein for generating a control signal; and means responsive to said control signal for supplying current through said thermoelectric module means in said first direction when one of heating and cooling is required for adjusting the actual temperature of the air in said room and for supplying current through said thermoelectric module means in said opposite direction when the other of said heating and cooling is required for adjusting the actual room temperature to the desired room temperature.

10. A heating and cooling system for controlling the temperature of a room, comprising:

existing ducting means operatively disposed in the upper wall portions of said room whose individual temperatures to be independently controlled for forming an air conduit therethrough, thermoelectric module means having first and second sides, said first and second sides being hot and cold, respectively, when current passes through said module in a first direction and becoming cold and hot, respectively, when said current passes through said module in a second opposite direction, said thermoelectric module means including a first heat exchange region proximate said first side and a second heat exchange region proximate said second side, each of said heat exchange regions having an input and an output;

a first inlet duct means operatively coupled to the inlet of said first heat exchange region of said first side of said thermoelectric module means and to said room;

a first outlet duct means operatively coupled to the output of said first heat exchange region of said housing means on the first side of said thermoelectric module means and to a said room;

a first fan means operatively disposed within said housing means and within said first inlet duct means for drawing in air from said room and forcing said air through said first heat exchange region and returning said air back to said room for maintaining a continuous air flow through said second heat exchange region;

means for supplying DC current to said thermoelectric module means;

means responsive to the actual temperature of the air in said room whose temperature is to be controlled and the desired temperature to be maintained therein for generating a control signal; and means responsive to said control signal for supplying current through said thermoelectric module means in said first direction when one of heating and cooling is required for adjusting the actual temperature of the air in the room in one direction and for supplying current through said thermoelectric module means in said opposite direction when the other of said heating and cooling is required for adjusting the actual room temperature.

11. In a central heating and cooling system having a system of existing ducts proximate the upper portions of the wall or ceiling, an improved method of heating and cooling an individual room comprising:

providing a series of thermoelectric modules having first and second sides, said first and second sides being hot and cold, respectively, when current passes through said series of modules in a first direction and becoming cold and hot, respectively, when said current passes through said series of modules in a second opposite direction, said series of thermoelectric modules including a first heat exchange zone proximate said first side and a second heat exchange zone proximate said second side;

mounting said series of thermoelectric modules in a housing;

operatively disposing said housing substantially entirely within said existing duct;

orienting said housing within said duct such that a duct inlet and a duct outlet are positioned in a side-by-side manner with both said inlet and said outlet opening into said room whose temperature is to be independently controlled;

drawing air from said room into said inlet and through said first heat exchange zone;

selectively heating and cooling said air within said heat exchange zone depending upon the direction of current in said series of thermoelectric modules;

returning conditioned air from said outlet to said room for maintaining a desired temperature;

drawing air through said existing ducts from a remote region into the second side of said housing;

passing the air on said second side of said housing through the second heat exchange zone for heat exchange purposes;

returning spent air from the outlet of said second heat exchange zone to said remote region through said existing ducts;

supplying direct current to the series of thermoelectric modules;

sensing the actual temperature of the air in said room whose temperature is to be maintained;

generating a control signal when the actual temperature must be increased and decreased to conform to the temperature desired within said room; and controlling the direction of current through said series of thermoelectric modules in accordance with said control signal for selectively heating and cooling said air through said first heat exchange zone for continually adjusting the actual temperature of the air to restore the temperature in the room to the desired level.

* * * * *